US006604958B2

(12) United States Patent
Watanabe

(10) Patent No.: US 6,604,958 B2
(45) Date of Patent: Aug. 12, 2003

(54) TERMINAL AND ELECTRICAL CONNECTOR WITH THE TERMINAL

(75) Inventor: Satoshi Watanabe, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/072,884

(22) Filed: Feb. 12, 2002

(65) Prior Publication Data

US 2002/0119694 A1 Aug. 29, 2002

(30) Foreign Application Priority Data

Feb. 23, 2001 (JP) ..... 2001-047719

(51) Int. Cl.[7] ..... H01R 11/20
(52) U.S. Cl. ..... 439/425; 439/422; 439/426
(58) Field of Search ..... 439/422, 425, 439/424, 396, 395, 400, 426, 427

(56) References Cited

U.S. PATENT DOCUMENTS 4,018,499 A * 4/1977 Rickards ..... 439/396
4,565,418 A * 1/1986 Graeser et al. ..... 439/395
6,386,901 B1 * 5/2002 Caldwell ..... 439/425

FOREIGN PATENT DOCUMENTS

DE 3526707 A1 * 1/1987 ..... 439/395
JP 11-345640 12/1999

* cited by examiner

*Primary Examiner*—Tho D. Ta
(74) *Attorney, Agent, or Firm*—Kanesaka & Takeuchi

(57) ABSTRACT

A terminal (11) comprises a contact section (16) for penetrating the insulation (C2) of a cable (C) to come to contact with the core wires (C1). The contact section (16) has a central crest portion (16B) and a pair of pressure faces (16A) extending outwardly from the crest portion (16B).

6 Claims, 5 Drawing Sheets

TERMINAL AND ELECTRICAL CONNECTOR WITH THE TERMINAL

BACKGROUND OF THE INVENTION

1. Field of the Invention

The present invention relates to a terminal with its contact section penetrating an insulated wire and an electrical connector having the terminal.

2. Description of the Related Art

An example of such a terminal and an electrical connector is disclosed in Japanese patent application Kokai No 11-345640. As shown in FIG. 4, this connector comprises a housing 51 made of an dielectric material so as to have a slot 51A extending in parallel to the sheet and a terminal 52 made of a metal sheet without bending. A plurality of such slots are arranged at regular intervals in the third direction perpendicular to the sheet to receive terminals 52 one for each slot.

The terminal 52 has an upper fixing arm 53 and a lower flexible arm 54. The fixing arm 53 is provided with a rotation support 53A, and the flexible arm 54 are provided with two contact portions 54A at its tip. As shown in FIG. 5, the contact portions 54A are tapered to the upper edge.

Referring back to FIG. 4, a rotary pressure member 55 is rotatable between the open position indicated in broken line and the closed position indicated in solid line. It extends in the third direction to cover the entire range of the terminals. It has a depending pressure section 55A in which a cable-receiving groove 55B extends in alignment with the slot 51A.

In use, bringing the pressure member 55 to the open position makes a space between the pressure member 55 and the contact section 54A of the terminal, which is sufficiently large to receive a flat cable C or the like. Then, the pressure member 55 is rotated to the closed position so that the bottom of the cable-receiving groove 55B presses the cable C against the contact section 54A. When the cable C is pressed against the contact section 54A, the contact section 54A of each terminal penetrates the insulation of the cable to make contact with the core wire, making electrical connection.

However, this connector suffers poor contact between the terminal and the core wire.

As shown in FIG. 5, the contact section 54A penetrates the insulation C2 of the cable C to make contact with the core wires C1. However, many core wires C1 are pushed aside by the contact section 54A so that not only the contact pressure decreases but also some of the core wires do not come to contact with the contact section 54A, reducing the contact area. This happens because the contact section 54A extends in the same direction as the core wires.

SUMMARY OF THE INVENTION

Accordingly, it is an object of the invention to provide a terminal capable of keeping good contact with core wires and an electrical connector having such a terminal.

According to an aspect of the invention there is provided a terminal comprising an elongated piece of metal sheet having a front portion and a contact section provided on an upper edge of the front portion. The contact section has a central crest portion for penetrating the insulation of a cable to come to contact with a plurality of core wires of the cable and a pressure faces extending outwardly from the crest portion for compressing the core wires, thus minimizing the electrical resistance.

When the cable is pressed against the terminal, the contact section penetrates the insulation of the cable to enter among the core wires. The pressure faces presses the core wires, providing high contact pressure and large contact area.

According to another aspect of the invention there is provided an electrical connector comprising a housing for supporting such terminals as described above and a pressure member for pressing the cable against the terminal. The pressure member comprises a cable-receiving groove having side walls that restrict lateral expansion of the cable when the contact section penetrates the cable.

According to still another aspect of the invention there is provided an electrical connector comprising a terminal having a contact section for penetrating the insulation of a cable to come to contact with core wires of the cable and a pressure member having a cable-receiving groove for receiving and pressing the cable against the contact section. The cable-receiving groove has a primary receiving groove for receiving the cable before the contact section penetrates the insulation; a secondary receiving groove in which the cable is pushed by the contact section and having side walls for restricting lateral expansion of the cable when the contact section penetrates the cable; and a neck section for communicating the primary and secondary receiving grooves and having a width that is smaller than a diameter of the cable but sufficiently large to allow the cable to pass through by deformation under pressure.

When the cable in the primary receiving groove is pressed against the contact section of the terminal, the crest portion enters among the core wires and pushes the cable into the secondary receiving groove. The side walls of the secondary receiving groove prevents expansion of the cable so that the contact section makes contact with many core wires under high contact pressure, increasing the contact area.

The neck section has a width that gradually decreases toward the secondary receiving groove to not only facilitate insertion of the cable into the secondary receiving groove but also assure catch of the cable by the contact section.

DESCRIPTION OF THE PREFERRED EMBODIMENTS

First Embodiment

Figure 1:
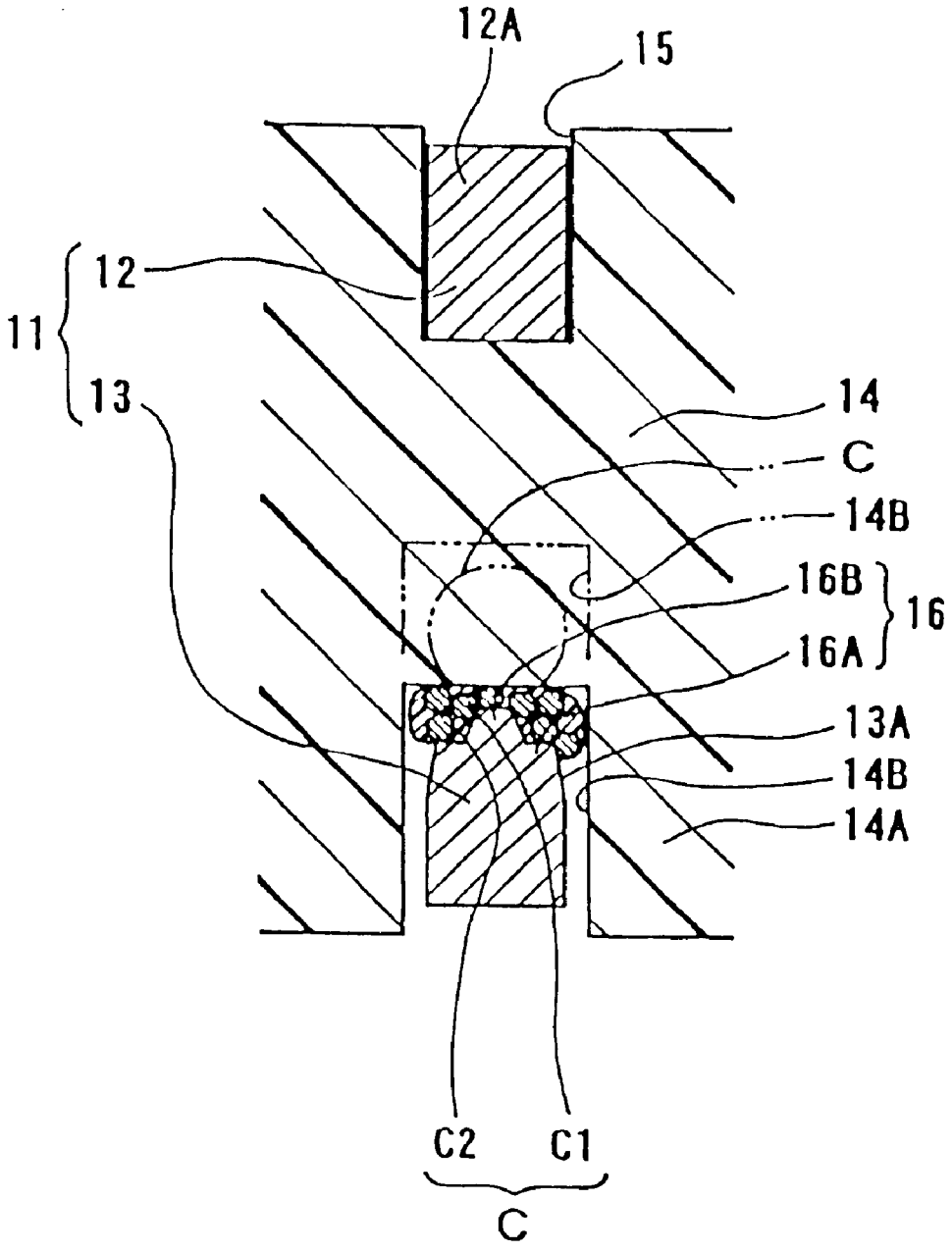
FIG. 1 is a sectional view of the essential part of an electrical connector with a terminal to which a cable has been connected according to an embodiment of the invention.
Figure 4:
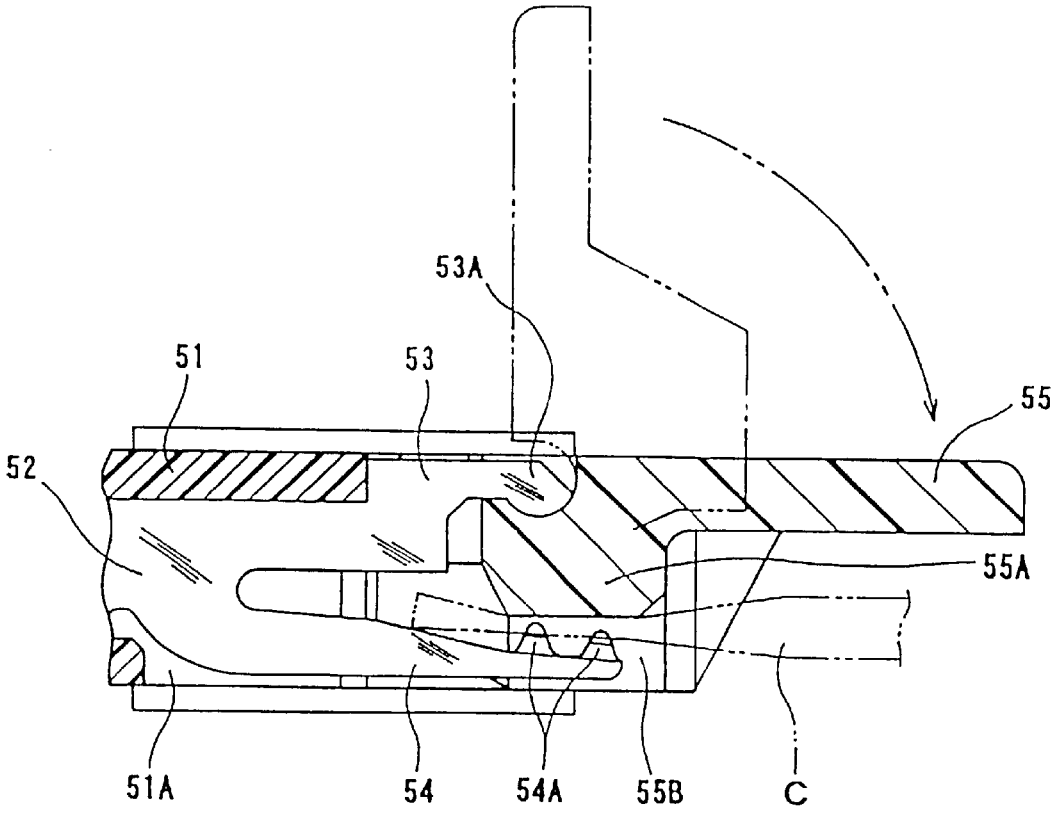
FIG. 4 PRIOR ART
FIG. 4 is a sectional view of a conventional connector taken along line parallel to the cable.
Figure 5:
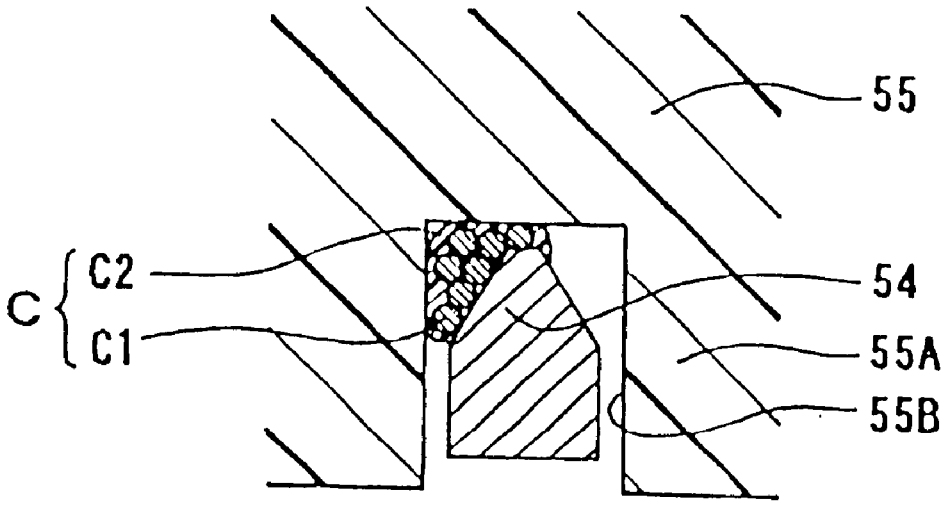
FIG. 5 PRIOR ART
FIG. 5 is a sectional view of the conventional connector to which a cable has been connected.

In FIG. 1, similarly to the conventional terminal 52 in FIG. 4, a terminal 11 comprises a fixing arm 12 and a flexible arm 13. It is supported by the housing of a connector such that it is pressed against a cable by a pressure member that is rotatable. The structures of the housing and the pressure member are the same as those of FIG. 4 and, therefore, their description will be omitted.

A cable-receiving groove 14B is provided in the pressure section 14A of a pressure member 14. A bearing groove 15 is provided in the pressure section 14A above the cable-receiving groove 14B to receive the rotation support 12A of the fixing arm 12.

The sectional shape of this contact section 16 is different from the sectional shape of the conventional contact section in FIG. 4. The contact section 16 of the terminal 11, which is made by stamping, undergoes a pressing process so that it has a stepped shape in the thicknesswise direction of the metal sheet. More specifically, it has a pair of tapered faces 13A on opposite sides, a pair of pressure faces 16A extending horizontally from the tapered faces 13A, and a crest portion 16B extending upwardly from the pressure faces 16A. The pressure faces 16A and the crest portion 16B constitute the contact section 16.

How to use such a connector will be described below.

(1) First of all, the pressure member 14 is rotated to the open position in FIG. 4 to make a large space between the pressure member 14 and the contact section 16 of the terminal 11. Consequently, there is provided a large space between the contact section 16 and the bottom of the cable-receiving groove 14B.

(2) Then, the cable C is inserted into the cable-receiving groove 14B. If the cable C is a flat cable, it is necessary to separate a length of the flat cable into individual insulated cables before insertion.

(3) Then, the pressure member 14 is rotated to the closed position so that the bottom of the cable-receiving groove 14B presses the cable against the contact section 16. Consequently, the contact section 16 penetrates the insulation C2 to come to contact with some of the wires C1. The cable C consists of a plurality of wires C1. The crest portion 16B of the contact section 16 extends in the longitudinal direction of the wires so that it enters between wires without difficulty. The wires divided into opposite sides of the crest portion 16B come to contact with the pressure faces 16A under high contact pressure. The insulation C2 of the cable is kept from expanding beyond the certain extent by the side walls of the cable-receiving groove 14B so that the wires C1 cannot escape from the pressure faces 16A.

Alternatively, the pressure faces 16A may extend obliquely horizontally from the tapered faces 13A.

Figure 2:
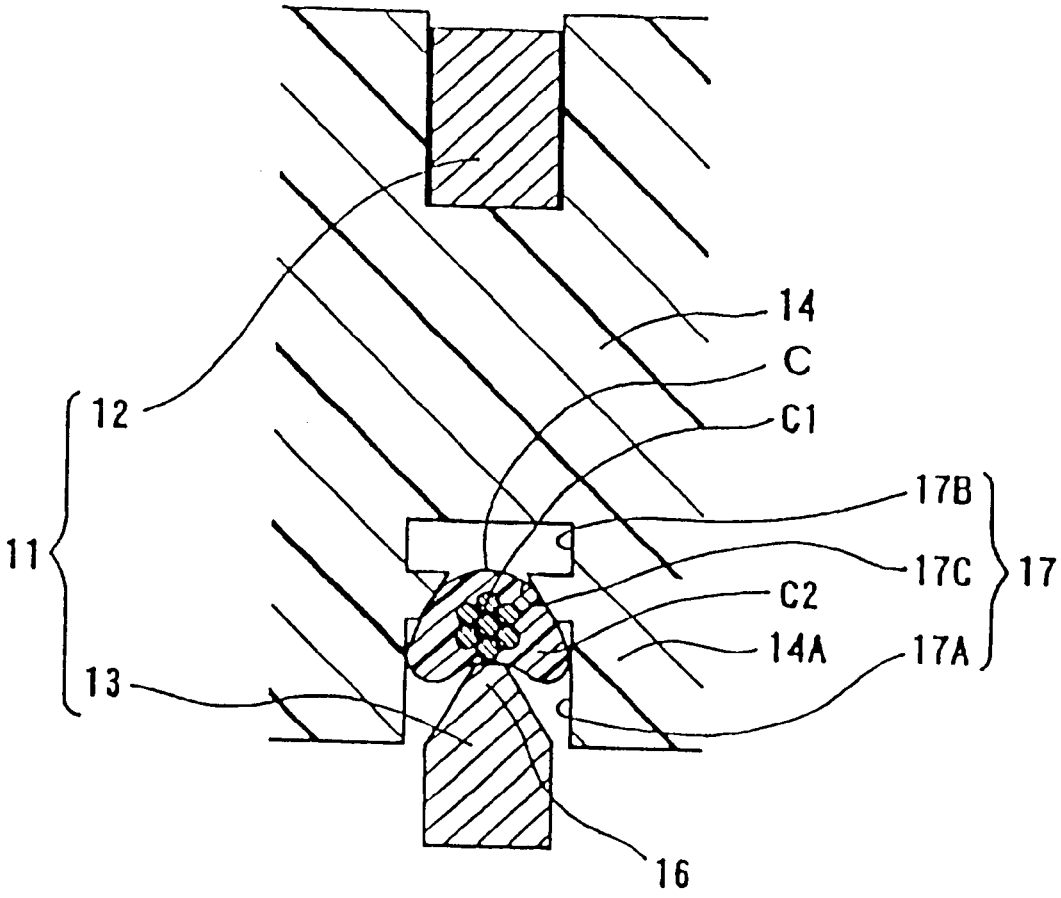
FIG. 2 is a sectional view of the essential part of an electrical connector to which a cable is being connected according to another embodiment of the invention.

Second Embodiment:

In FIG. 2, the contact section 16 of a terminal 11 is the same as the contact section in FIG. 4 and has a pair of tapered faces on opposite sides.

A cable receiving groove 17 is provided in the pressure section 14A of a pressure member 14 and has a primary receiving groove 17A, a secondary receiving groove 17B, and a neck section 17C for communicating both the grooves. The primary and secondary receiving grooves 17A and 17B both have a rectangular section, but the former opens downwardly and has a width and a depth that are slightly greater than the diameter of a cable C prior to deformation and the latter has a depth that is smaller than the cable diameter. The neck section 17C has side walls inclined toward each other so that the neck width gradually decreases from the primary to the secondary groove 17B.

In use, when the pressure member 14 is brought to the open position, a space is formed between the primary receiving groove 17A and the contact section 16 that is sufficiently large to receive a cable C.

Figure 3:
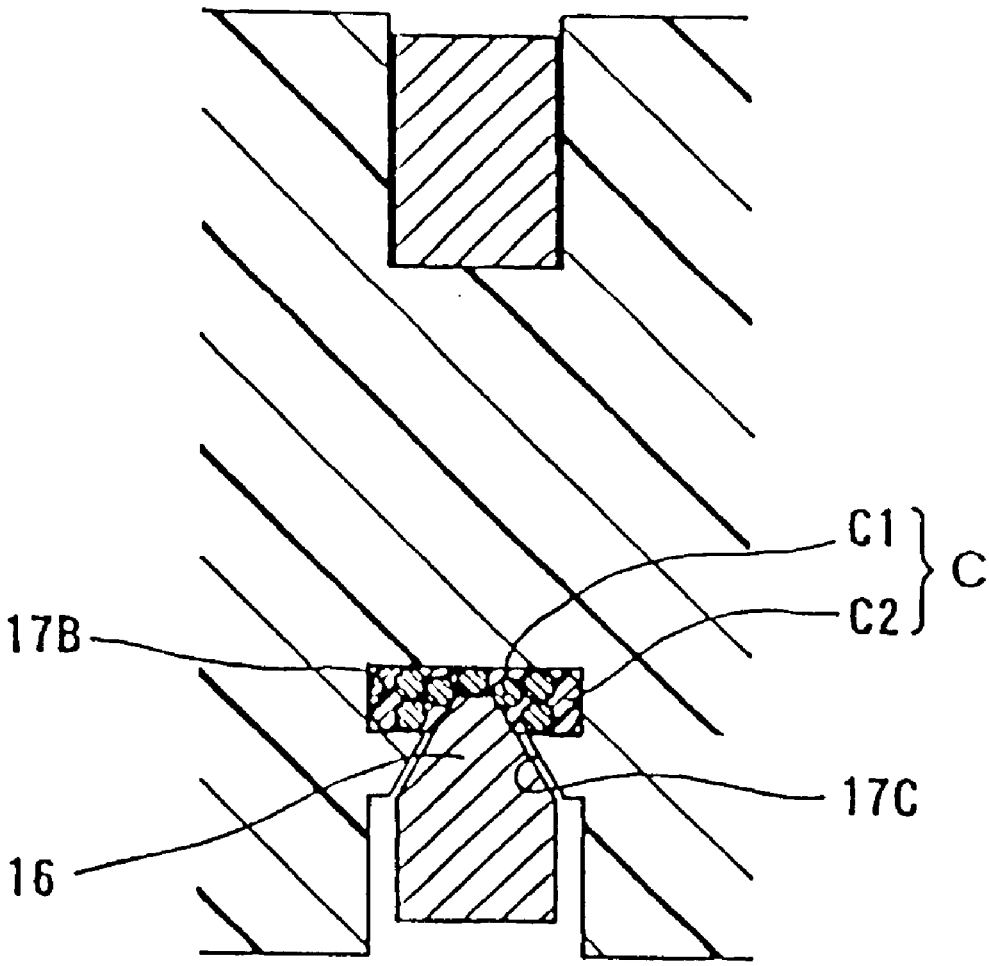
FIG. 3 is a sectional view of the essential part of the electrical connector in FIG. 2 to which a cable has been connected.

Then, when the pressure member 14 is rotated to the closed position, the contact section 16 starts to penetrate the insulation C2 of the cable C as shown in FIG. 2. When the contact section 16 penetrates between the wires C1, the wires C1 are no longer pushed aside. When the pressure section 16 further penetrates, the cable C is compressed by the neck section 17C and pushed into the secondary receiving groove 17B, in which the contact section 16 are brought into contact with many wires C1 as shown in FIG. 3. The side walls of the secondary receiving groove 17B prevents the cable from expanding beyond the limits so that a high contact pressure is produced between the contact section 16 and the wires C1.

As has been described above, according to the invention, a plurality of wires of a cable are caught by the contact section without failure so that not only a satisfactory contact pressure but also a large contact area are obtained, thus minimizing the electrical resistance and maximizing the reliability.

What is claimed is:

1. A terminal comprising:

an elongated piece of metal extending in an insertion direction of a cable and having a front portion;

a contact section provided on an upper edge of said front portion and extending in said insertion direction, said contact section having a central crest portion for penetrating an insulation of said cable to contact with a plurality of core wires of said cable; and a pair of pressure faces extending outwardly from said crest portion for compressing and contacting with said core wires.

2. The terminal according to claim 1, wherein said central crest portions and pressure faces are provided in a thicknesswise direct of said elongated piece of metal.

3. An electrical connector comprising:

a housing for supporting said terminal according to claim 1 and a pressure member for pressing said cable against said terminal.

4. The electrical connector according to claim 3, wherein said pressure member comprises a cable-receiving groove having side walls that restrict lateral expansion of said cable when said contact section penetrates said cable.

5. An electrical connector comprising:

a terminal having a contact section for penetrating an insulation of a cable to come to contact with a core wire of said cable;

a pressure member having a cable-receiving groove for receiving and pressing said cable against said contact section; said cable-receiving groove having a primary receiving groove for receiving said cable before said contact section penetrates said insulation;

a secondary receiving groove in which said cable is pushed by said contact section and having side walls for restricting lateral expansion of said cable when said contact section penetrates said cable; and a neck section for communicating said primary and secondary receiving grooves and having a width that is smaller than a diameter of said cable but sufficiently large to allow said cable to pass through by deformation under pressure.

6. The electrical connector according to claim 5, wherein said neck section with its width gradually decreases toward said secondary receiving groove.

* * * * *